US009741506B1

(12) United States Patent
Tsai et al.

(10) Patent No.: US 9,741,506 B1
(45) Date of Patent: Aug. 22, 2017

(54) KEYBOARD DEVICE

(71) Applicant: Primax Electronics Ltd., Neihu, Taipei (TW)

(72) Inventors: Lei-Lung Tsai, Taipei (TW); Yi-Chen Wang, Taipei (TW)

(73) Assignee: PRIMAX ELECTRONICS LTD., Neihu, Taipei (TW)

( * ) Notice: Subject to any disclaimer, the term of this patent is extended or adjusted under 35 U.S.C. 154(b) by 16 days.

(21) Appl. No.: 15/077,821

(22) Filed: Mar. 22, 2016

(30) Foreign Application Priority Data

Feb. 19, 2016 (TW) ..... 105105025 A

(51) Int. Cl.
*H01H 13/705* (2006.01)
*H01H 3/12* (2006.01)

(52) U.S. Cl.
CPC ..... *H01H 13/705* (2013.01); *H01H 3/125* (2013.01); *H01H 2233/002* (2013.01); *H01H 2239/034* (2013.01)

(58) Field of Classification Search
CPC ... H01H 13/83; H01H 2219/062; H01H 3/125
USPC ..... 200/341–345, 5 A, 302.1, 302.2
See application file for complete search history.

(56) References Cited

U.S. PATENT DOCUMENTS 6,906,273 B2 * 6/2005 Searle ..... H01H 13/702 200/343
2009/0301852 A1 * 12/2009 Keist ..... B60K 37/06 200/341
2010/0288615 A1 * 11/2010 Mafune ..... H01H 13/83 200/5 A
2011/0056817 A1 * 3/2011 Wu ..... H01H 13/14 200/344

* cited by examiner

*Primary Examiner* — Edwin A. Leon
*Assistant Examiner* — Ahmed Saeed
(74) *Attorney, Agent, or Firm* — Kirton McConkie; Evan R. Witt

(57) ABSTRACT

A keyboard device includes plural keycaps and a membrane switch circuit member. The membrane switch circuit member is disposed under the plural keycaps. The membrane switch circuit member includes a wiring board and plural separate covering pads. The wiring board includes plural first trace patterns and plural second trace patterns corresponding to the plural keycaps. The plural second trace patterns are disposed on the wiring board and separated from the plural first trace patterns. There is a gap between each first trace pattern and the adjacent second trace pattern. The covering pads are disposed over the wiring board. The plural covering pads are aligned with the corresponding keycaps and cover the corresponding gaps. The covering pad has a triggering trace pattern over the corresponding gap.

9 Claims, 4 Drawing Sheets

KEYBOARD DEVICE

FIELD OF THE INVENTION

The present invention relates to a keyboard device, and more particularly to a keyboard device with scissors-type connecting elements.

BACKGROUND OF THE INVENTION

Generally, the widely-used peripheral input device of a computer system includes for example a mouse device, a keyboard device, a trackball, or the like. Via the keyboard board, characters or symbols can be directly inputted into the computer system. As a consequence, most users and most manufacturers of input devices pay much attention to the development of keyboard devices.

Hereinafter, the structure of a conventional keyboard device will be illustrated with reference to FIG. 1. FIG. 1 is a schematic side cross-sectional view illustrating a conventional keyboard device. As shown in FIG. 1, the conventional keyboard device 1 comprises plural keycaps 11, plural scissors-type connecting elements 12, plural rubbery elastomers 13, a membrane switch circuit member 14 and a base 15. The plural keycaps 11, the plural scissors-type connecting elements 12, the plural rubbery elastomers 13 and the membrane switch circuit member 14 are supported by the base 15. The scissors-type connecting elements 12 are used for connecting the base 15 and the corresponding keycaps 11.

The membrane switch circuit member 14 comprises an upper wiring board 141, a spacer layer 142 and a lower wiring board 143. The upper wiring board 141 has plural upper contacts 1411. The spacer layer 142 comprises plural perforations 1421. The lower wiring board 143 comprises plural lower contacts 1431 corresponding to the plural upper contacts 1411. When a specified position of the membrane switch circuit member 14 is triggered, the upper contact 1411 corresponding to the triggered position is inserted into the corresponding perforation 1421 and contacted with the corresponding lower contact 1431. The upper contact 1411, the corresponding perforation 1421 and the corresponding lower contact 1431 are collaboratively defined as a key intersection. Moreover, the areas of the upper wiring board 141, the spacer layer 142 and the lower wiring board 143 are equal. The plural rubbery elastomers 13 are disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The plural scissors-type connecting elements 12 are arranged between the base 15 and the plural keycaps 11, and the base 15 and the plural keycaps 11 are connected with each other through the scissors-type connecting elements 12. Each scissors-type connecting element 12 comprises a first frame 121 and a second frame 122. A first end of the first frame 121 is connected with the keycap 11. A second end of the first frame 121 is connected with the base 15. Moreover, the rubbery elastomer 13 is enclosed by the corresponding scissors-type connecting element 12.

The operations of the conventional keyboard device 1 in response to the depressing action of the user will be illustrated as follows. Please refer to FIG. 1 again. When the keycap 11 is depressed by the user, the keycap 11 is moved downwardly to push the corresponding scissors-type connecting element 12 in response to the depressing force. As the keycap 11 is moved downwardly relative to the base 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

Recently, the general trends of designing electronic devices and their peripheral devices are toward slimness, light weightiness an easy portability. Consequently, keyboard devices and other peripheral devices need to meet the requirements of slimness. For achieving this purpose, the manufacturers make efforts in minimizing the thickness of the keyboard devices. Under this circumstance, the movable distance of the keycap (also referred as a travelling distance) is shortened. Consequently, the tactile feel of depressing the key of the keyboard device is deteriorated.

Therefore, there is a need of providing a key structure with reduced thickness and enhanced tactile feel.

SUMMARY OF THE INVENTION

An object of the present invention provides a key structure with reduced thickness and enhanced tactile feel.

In accordance with an aspect of the present invention, there is provided a keyboard device. The keyboard device includes plural keycaps and a membrane switch circuit member. The membrane switch circuit member is disposed under the plural keycaps. When the membrane switch circuit member is triggered by one of the plural keycaps, a corresponding key signal is generated. The membrane switch circuit member includes a wiring board and plural separate covering pads. The wiring board includes plural first trace patterns and plural second trace patterns. The plural first trace patterns are disposed on the wiring board and aligned with respective keycaps. The plural second trace patterns are disposed on the wiring board and aligned with respective keycaps. There is a first gap between each first trace pattern and the adjacent second trace pattern. The covering pads are disposed over the wiring board, wherein the plural covering pads are aligned with the corresponding keycaps and cover the corresponding first gaps. The covering pad has a triggering trace pattern over the corresponding first gap. The plural first trace patterns, the plural second trace patterns and the plural triggering trace patterns are sealed in a space between the plural covering pads and the wiring board, so that foreign liquid is prevented from being introduced into the membrane switch circuit member.

From the above descriptions, the present invention provides the keyboard device. The plural separate covering pads and the wiring board are collaboratively formed as the membrane switch circuit member. Each covering pad is aligned with the corresponding keycap. In comparison with the conventional three-layered membrane switch circuit member, the membrane switch circuit member of the present invention is two-layered structure with the covering pads and the wiring board. Consequently, the membrane switch circuit member of the present invention has reduced thickness. According to the present invention, the wiring board is not completely covered by the covering pads. That is, the covering pads are discretely disposed on the wiring board. Consequently, when the keycap is depressed by the user, the movement of the periphery part of the keycap is not obstructed by the covering pad. That is, the periphery part of the keycap is inserted into the region between the adjacent covering pads. Moreover, there is another gap between the periphery part of the keycap and the covering pad. Since the plural separate covering pads and the wiring board are collaboratively formed as the membrane switch circuit member, the travelling distance of the keycap is increased.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with enhanced tactile feel and slim appearance.

Figure 1:
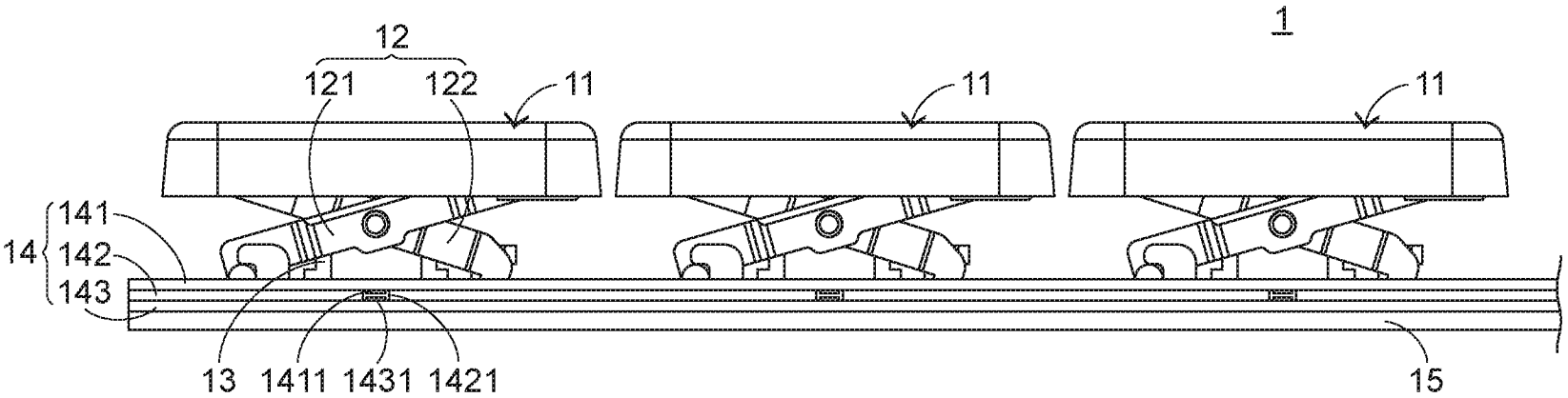
FIG.1 PRIOR ART
FIG. 1 is a schematic side cross-sectional view illustrating a conventional keyboard device.
Figure 2:
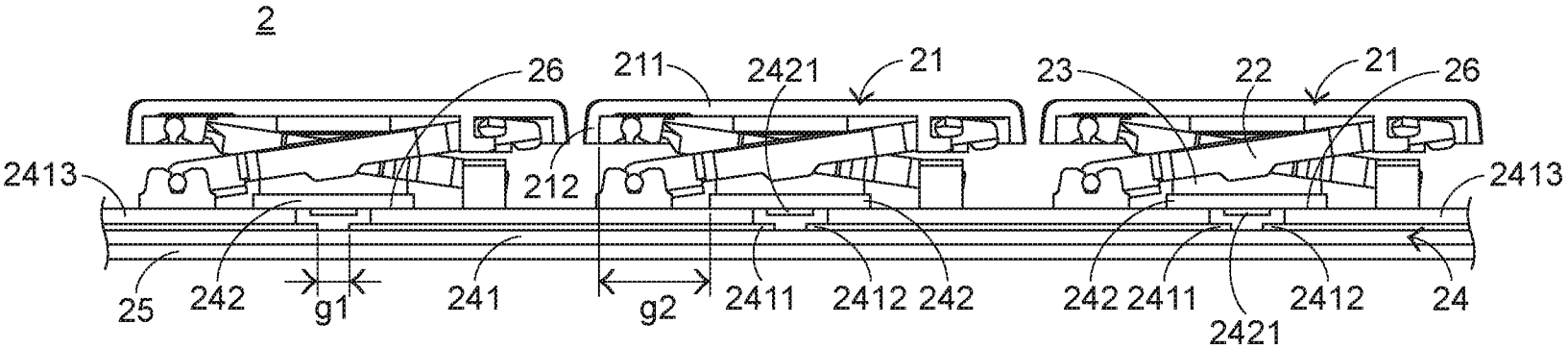
FIG. 2 is a schematic side cross-sectional view illustrating a keyboard device according to an embodiment of the present invention.
Figure 3:
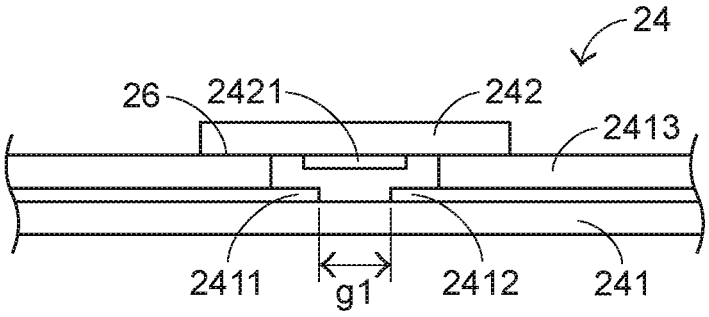
FIG. 3 is a schematic side cross-sectional view illustrating a membrane switch circuit member of the keyboard device according to the embodiment of the present invention.

FIG. 2 is a schematic side cross-sectional view illustrating a keyboard device according to an embodiment of the present invention. FIG. 3 is a schematic side cross-sectional view illustrating a membrane switch circuit member of the keyboard device according to the embodiment of the present invention. As shown in FIGS. 2 and 3, the keyboard device 2 comprises plural keycaps 21, plural scissors-type connecting elements 22, plural triggering elements 23, a membrane switch circuit member 24 and a base 25. The membrane switch circuit member 24 is disposed under the plural keycaps 21. When the membrane switch circuit member 24 is triggered by one of the plural keycaps 21, the membrane switch circuit member 24 is triggered to generate a corresponding key signal. The membrane switch circuit member 24 comprises a wiring board 241 and plural separate covering pads 242. Moreover, the wiring board 241 comprises plural first trace patterns 2411, plural second trace patterns 2412 and plural insulation layers 2413. The plural first trace patterns 2411 are disposed on the wiring board 241. Each of the first trace patterns 2411 is aligned with the corresponding keycap 21. The plural second trace patterns 2412 are disposed on the wiring board 241. Each of the second trace patterns 2412 is separated from the adjacent first trace pattern 2411, and aligned with the corresponding keycap 21. There is a gap g1 between each first trace pattern 2411 and the adjacent second trace pattern 2412. The plural insulation layers 2413 are disposed over the plural first trace patterns 2411 and the plural second trace patterns 2412. By the plural insulation layers 2413, the plural first trace patterns 2411 and the plural second trace patterns 2412 are not exposed outside. That is, the plural insulation layers 2413 can provide insulating efficacy.

Figure 4:
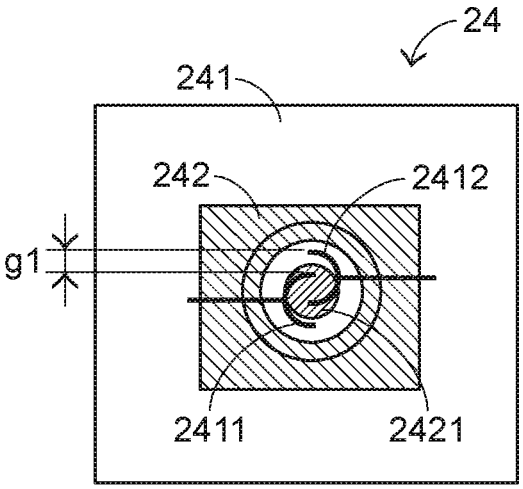
FIG. 4 is a schematic top view illustrating a portion of the membrane switch circuit member of the keyboard device according to the embodiment of the present invention.

FIG. 4 is a schematic top view illustrating a portion of the membrane switch circuit member of the keyboard device according to the embodiment of the present invention. Please refer to FIGS. 3 and 4. The plural separate covering pads 242 are disposed over the wiring board 241. Moreover, each covering pad 242 is aligned with the corresponding pad 21, and covers the corresponding gap g1. Each covering pad 242 comprises a triggering trace pattern 2421. The triggering trace pattern 2421 is disposed over the corresponding gap g1. As shown in FIG. 4, the first trace pattern 2411 and the adjacent second trace pattern 2412 are separated from each other to define the gap g1. In this embodiment, the wiring board 241 and at least one of the plural separate covering pads 242 are made of polyethylene terephthalate (PET).

The following two aspects should be specially described. Firstly, the keyboard device 2 further comprises plural adhesives 26. Each adhesive 26 is aligned with a corresponding covering pad 242. The plural adhesives 26 are disposed on the corresponding covering pads 242. Through the plural adhesives 26, the covering pads 242 and the wiring board 241 are combined together. Secondly, the plural first trace patterns 2411, the plural second trace patterns 2412 and the plural triggering trace patterns 2421 are sealed in the space between the plural covering pads 242 and the wiring board 241. Consequently, the foreign liquid (e.g., water or drink) is prevented from being introduced into the membrane switch circuit member 24. In other words, the membrane switch circuit member 24 is waterproof.

Please refer to FIGS. 2 and 3 again. Each triggering element 23 is aligned with one keycap 21 and one covering pad 242. That is, the plural triggering elements 23 are arranged between the corresponding keycaps 21 and the corresponding covering pads 242. When one of the keycaps 21 is depressed to push the corresponding triggering element 23, the corresponding covering pad 242 is pushed to trigger the membrane switch circuit member 24. In this embodiment, each keycap 21 comprises a pressing part 211 and a periphery part 212. The pressing part 211 is exposed outside the keyboard device 2 so as to be pressed by the user. The periphery part 212 is arranged around the pressing part 211 and protruded downwardly from the pressing part 211. In this embodiment, the triggering element 23 is a rubbery elastomer. It is noted that the example of the triggering element 23 is not restricted. In another embodiment, the triggering element is an elastic metal sheet.

The base 25 is disposed under the membrane switch circuit member 24. The plural keycaps 21, the plural scissors-type connecting elements 22, the plural triggering elements 23 and the membrane switch circuit member 24 are supported by the base 25. The plural scissors-type connecting elements 22 are arranged between the corresponding keycaps 21 and the base 25. Each scissors-type connecting element 22 is aligned with the corresponding keycap 21. The scissors-type connecting element 22 is moved with the keycap 21. Consequently, the keycap 21 can be moved upwardly or downwardly more stably.

The operations of the keyboard device 2 in response to the depressing action of the user will be illustrated as follows. When the pressing part 211 of a keycap 21 is depressed by the user, the keycap 21 is moved downwardly to push the corresponding scissors-type connecting element 22 in response to the depressing force. As the keycap 21 is moved downwardly relative to the base 25, the keycap 21 pushes the corresponding triggering element 23. At the same time, the triggering element 23 is subjected to deformation to push the corresponding covering pad 242 of the membrane switch circuit member 24. Consequently, the triggering trace pattern 2421 of the covering pad 242 is moved downwardly to be contacted with the corresponding first trace pattern 2411 and the corresponding second trace pattern 2412. Under this circumstance, the first trace pattern 2411 and the corresponding second trace pattern 2412 are electrically connected with each other, and the membrane switch circuit member 24 is triggered to generate the corresponding key signal. Moreover, while the keycap 21 is depressed and moved downwardly, the periphery part 212 of the keycap 21 is contacted with the wiring board 241. At the same time, the periphery part 212 is arranged around the corresponding covering pad 242, but not contacted with the corresponding covering pad 242. Consequently, as shown in FIG. 2, there is a second gap g2 between the periphery part 212 and the corresponding covering pad 242.

When the keycap 21 is no longer depressed by the user, no external force is applied to the keycap 21, and the triggering element 23 is no longer pushed by the keycap 21. In response to the elasticity of the triggering element 23, the triggering element 23 is restored to its original shape to provide an upward elastic restoring force to the keycap 21. Moreover, the scissors-type connecting element 22 is moved with the keycap 21. Consequently, the keycap 21 is moved upwardly to its original position more stably.

Figure 5:
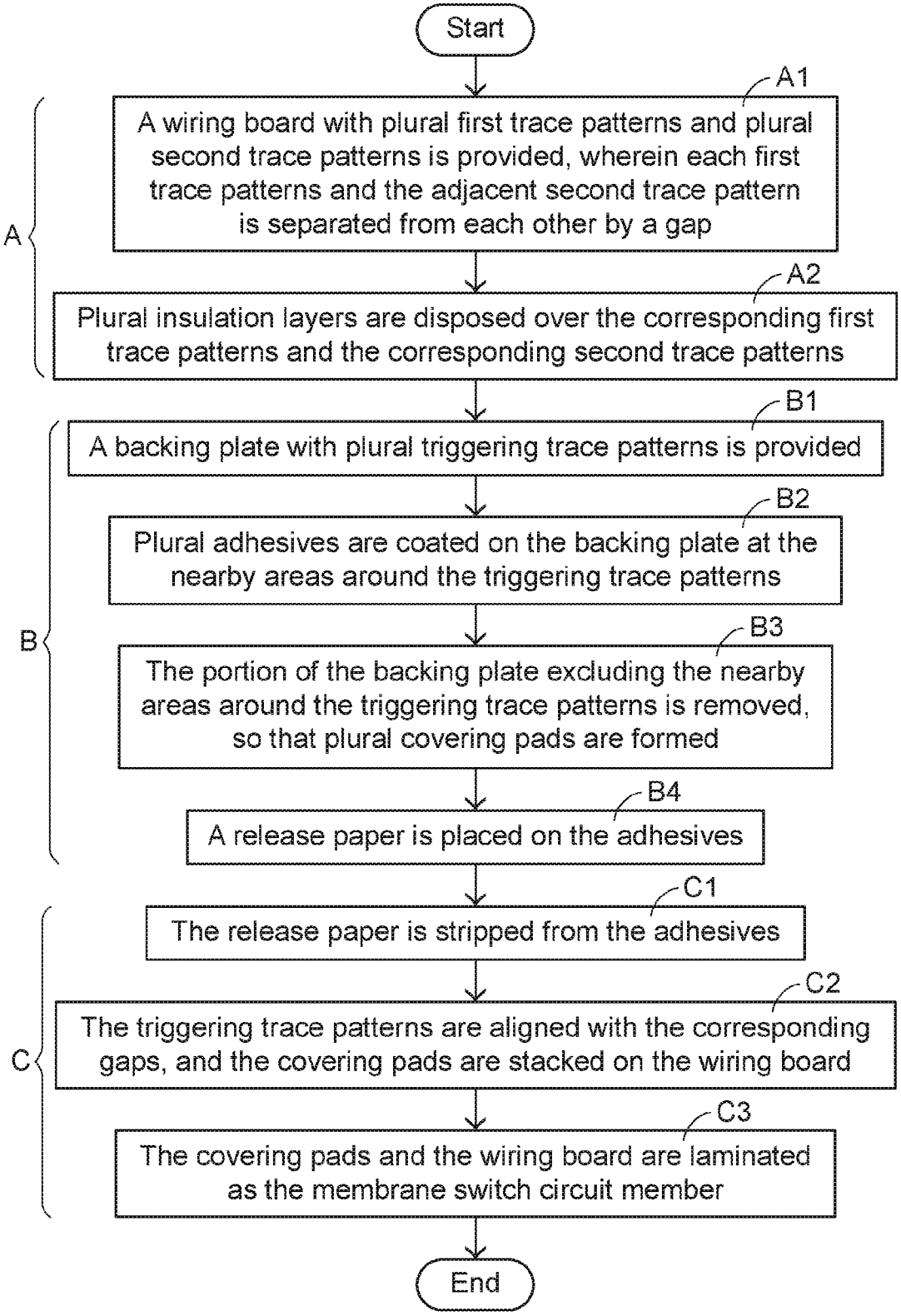
FIG. 5 is a flowchart illustrating a process of manufacturing the membrane switch circuit member of the keyboard device according to the embodiment of the present invention.

A process of manufacturing the membrane switch circuit member 24 of the keyboard device 2 will be illustrated as follows. FIG. 5 is a flowchart illustrating a process of manufacturing the membrane switch circuit member of the keyboard device according to the embodiment of the present invention. The process of manufacturing the membrane switch circuit member comprises the following steps. In a step A, a wiring board with plural first trace patterns and plural second trace patterns is provided, wherein each first trace pattern and the adjacent second trace pattern is separated from each other by a gap. In a step B, plural covering pads are provided, wherein each covering pad comprises a triggering trace pattern. In a step C, the plural covering pads are stacked on the wiring board, wherein the triggering trace pattern is disposed over the gap.

The step A comprises sub-steps A1 and A2. In the sub-step A1, the plural first trace patterns and the plural second trace patterns are formed on the wiring board, wherein each first trace pattern and the adjacent second trace pattern is separated from each other by the gap. In the sub-step A2, plural insulation layers are formed on the corresponding first trace patterns and the corresponding second trace patterns.

The step B comprises sub-steps B1, B2, B3 and B4. In the sub-step B1, a backing plate with plural triggering trace patterns is provided. In the sub-step B2, plural adhesives are coated on the backing plate at the nearby areas around the triggering trace patterns. In the sub-step B3, the portion of the backing plate excluding the nearby areas around the triggering trace patterns is removed, so that plural covering pads are formed. In the sub-step B4, a release paper is placed on the adhesives.

The step C comprises sub-steps C1, C2 and C3. In the sub-step C1, the release paper is stripped from the adhesives. In the sub-step C2, the triggering trace patterns are aligned with the corresponding gaps, and the covering pads are stacked on the wiring board. In the sub-step C3, the covering pads and the wiring board are laminated as the membrane switch circuit member.

After the above steps are performed, the plural separate covering pads 242 and the wiring board 241 are collaboratively formed as the membrane switch circuit member 24. Each covering pad 242 is aligned with the corresponding keycap 21. In comparison with the conventional three-layered membrane switch circuit member, the membrane switch circuit member 24 of the present invention is two-layered structure with the covering pads 242 and the wiring board 241. Consequently, the membrane switch circuit member 24 of the present invention has reduced thickness. In this embodiment, the wiring board 241 is not completely covered by the covering pads 242. That is, the covering pads 242 are discretely disposed on the wiring board 241. Consequently, when the keycap 21 is depressed by the user, the movement of the periphery part 212 of the keycap 21 is not obstructed by the covering pad 242. That is, the periphery part 212 of the keycap 21 is inserted into the region between the adjacent covering pads 242. Moreover, there is another gap g2 between the periphery part 212 of the keycap 21 and the covering pad 242. Since the plural separate covering pads 242 and the wiring board 241 are collaboratively formed as the membrane switch circuit member 24, the travelling distance of the keycap 21 is increased.

In the above embodiment, the keyboard device uses the scissors-type connecting element to control the upward/downward movement of the keycap. However, another element for moving the keycap can be adopted according to the practical requirements.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device, comprising:

plural keycaps; and a membrane switch circuit member disposed under the plural keycaps, wherein when the membrane switch circuit member is triggered by one of the plural keycaps, a corresponding key signal is generated, wherein the membrane switch circuit member comprises:

a wiring board comprising plural first trace patterns and plural second trace patterns, wherein the plural first trace patterns are disposed on the wiring board and aligned with respective keycaps, and the plural second trace patterns are disposed on the wiring board, separated from the plural first trace patterns and aligned with respective keycaps, wherein there is a first gap between each first trace pattern and the adjacent second trace pattern; and plural separate covering pads disposed over the wiring board, wherein the plural covering pads are aligned with the keycaps and cover the first gaps, wherein each covering pad has a triggering trace pattern over a corresponding first gap, wherein the plural first trace patterns, the plural second trace patterns and the plural triggering trace patterns are sealed in a space between the plural covering pads and the wiring board, so that foreign liquid is prevented from being introduced into the membrane switch circuit member.

2. The keyboard device according to claim 1, wherein the keyboard device further comprises plural triggering elements, and the plural triggering elements are arranged between the keycaps and the covering pads, wherein when one of the plural triggering elements is pushed by a corresponding keycap, the corresponding covering pad is pushed by the triggering element, wherein when the corresponding covering pad is pushed by the triggering element, a corresponding trigging trace pattern is contacted with a corresponding first trace pattern and the corresponding second trace pattern, so that the corresponding first trace pattern and a corresponding second trace pattern are electrically connected with each other.

3. The keyboard device according to claim 2, wherein the triggering elements are rubbery elastomers.

4. The keyboard device according to claim 2, wherein the triggering elements are elastic metal sheets.

5. The keyboard device according to claim 1, further comprising plural adhesives, wherein the plural adhesives are disposed on the covering pads, and the plural covering pads and the wiring board are combined together through the plural adhesives.

6. The keyboard device according to claim 1, wherein the wiring board or each of the plural separate covering pads is made of polyethylene terephthalate (PET).

7. The keyboard device according to claim 1, wherein each first trace pattern and the adjacent second trace pattern are separated from each other to define the first gap.

8. The keyboard device according to claim 1, wherein the wiring board further comprises plural insulation layers, and the plural insulation layers are disposed over the plural first trace patterns and the plural second trace patterns, so that the plural first trace patterns and the plural second trace patterns are not exposed outside.

9. The keyboard device according to claim 1, wherein each of the plural keycaps comprises:

a pressing part exposed outside the keyboard device; and a periphery part arranged around the pressing part and protruded downwardly from the pressing part, wherein when the keycap is pressed and moved downwardly, the periphery part is contacted with the wiring board, and the periphery part is arranged around the corresponding covering pad but not contacted with a corresponding covering pad, so that there is a second gap between the periphery part and the corresponding covering pad.

* * * * *